United States Patent [19]

Kirsch

[11] 4,173,084

[45] Nov. 6, 1979

[54] SKI BOOTS

[76] Inventor: Bernhard Kirsch, Im Litzelholz 23, 5500 Trier-Biewer, Fed. Rep. of Germany

[21] Appl. No.: 936,084

[22] Filed: Aug. 23, 1978

[30] Foreign Application Priority Data

Aug. 26, 1977 [DE] Fed. Rep. of Germany ..... 2738523

[51] Int. Cl.[2] ..... A43B 5/04

[52] U.S. Cl. ..... 36/121

[58] Field of Search ..... 36/117, 120, 121

[56] References Cited

U.S. PATENT DOCUMENTS

| | | | |
|---|---|---|---|
| 3,486,247 | 12/1969 | Franet | 36/121 |
| 3,968,578 | 7/1976 | Rathmell | 36/121 |

*Primary Examiner*—Patrick D. Lawson

*Attorney, Agent, or Firm*—Robert W. Beach; Ward Brown

[57] ABSTRACT

This invention relates to ski-boots of the kind comprising a bottom part to carry the foot and an ankle cuff which is pivotable on said bottom part of the boot about a first pivot shaft extending transversely to the longitudinal direction of the boot, both said bottom part and said ankle cuff being made from a rigid material. According to the invention, the ankle cuff has plane sidewalls arranged parallel to and at a distance from one another which rest against the insides of plane sidewalls sections of the bottom part of the boot which are respectively associated with them; the first pivot shaft connecting the ankle cuff and the bottom part of the boot is arranged above the sole of the boot and to the rear of an axis aligned with the ankle joint of the intended wearer, (i.e. 5 to 10 cms above the boot sole), and at the front end, the ankle cuff has a transverse pin orientated parallel to the first pivot shaft whose ends are guided in a guide track of curved configuration in the bottom part of the boot.

21 Claims, 15 Drawing Figures

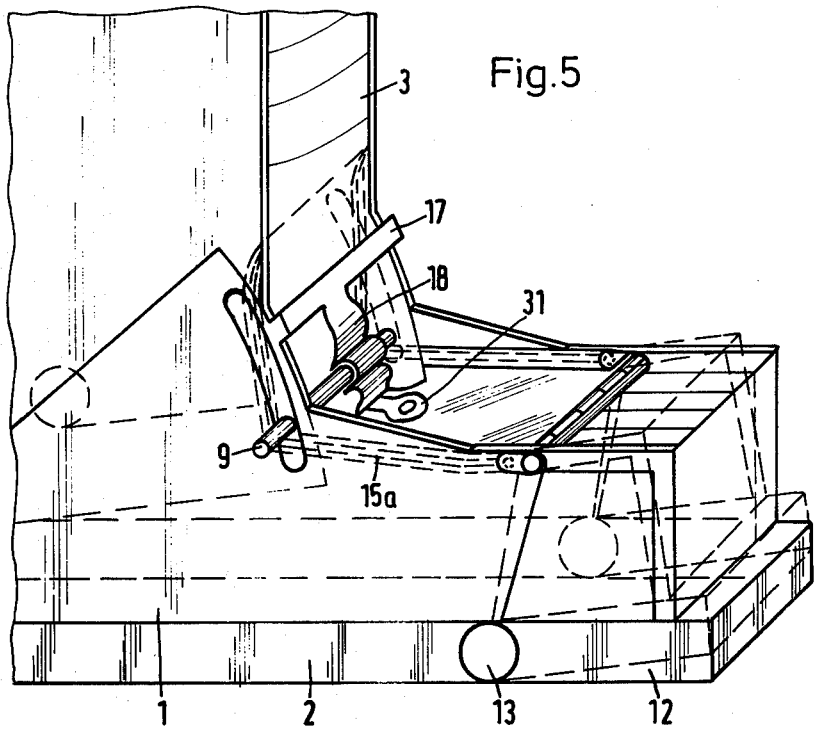
Fig.5
Fig.6
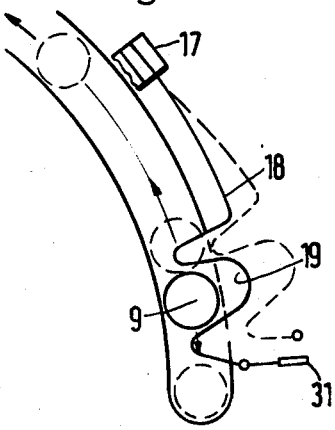
Fig.7
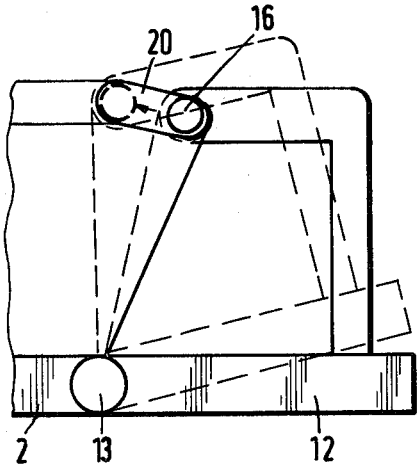

SKI BOOTS

BACKGROUND OF THE INVENTION

The present invention relates to ski-boots of the kind having a bottom part made of rigid material which carries the foot and a cuff for the ankle, also made of rigid material which is mounted to pivot on the bottom part of the boot about a pivot shaft extending transversly to the longitudinal direction of the boot.

In a known ski-boot of this kind, there is arranged on the bottom part of the boot an ankle cuff which can be tilted backwards about an axis of pivot on which the two parts are connected, so that in this way the foot can be inserted more easily. With this design, the pivot axis on the ankle cuff is situated approximately on the same line as the axis of articulation of the ankle joint.

However, the known ski-boot has the disadvantage that is not particularly suitable for walking without the ski attached, since in this case the foot is not sufficiently free to move in the boot because there is pressure on the instep in all positions.

It is therefore an object of the invention to produce a ski-boot of the kind described in such a way that it allows the foot to be freely movable in the walking state but holds the foot secure in the downhill skiing state.

SUMMARY OF THE INVENTION

This object is achieved in accordance with the invention by virtue of the facts that the ankle cuff has two plane side-walls arranged parallel to and at a distance from one another which rest against the insides of plane side-wall sections of the bottom part of the boot which are respectively associated with them, that the pivot shaft connecting the ankle cuff and the bottom part of the boot is arranged above the sole of the boot and to the rear of an axis aligned with the ankle-joint of the wearer, and that at the front the ankle cuff has a transverse pin orientated parallel to the pivot shaft whose ends are guided in a guide track of curved configuration in the bottom part of the boot.

Advantageously, the pivot shaft is arranged at the same distance from the sole of the boot as the axis aligned with the ankle joint of the wearer.

In a refinement, two end-of-travel stops are provided, together with a latch device which holds the transverse pin in place until a predetermined restraining force is overcome.

In a particular embodiment, a spring-clip containing recesses in which the transverse pin is able to engage, is arranged on the bottom part of the boot.

In another refinement, the toe of the boot and the toe-section of the sole associated with it are mounted to pivot on the bottom part of the boot, the pivot shaft being arranged in the sole of the boot parallel to the pivot shaft for the ankel cuff. The toe-section of the sole can be locked in position in a straight line with the sole of the boot.

Preferably, there is arranged on the side of the ankle cuff remote from the pivot shaft a gripping device which fits over the instep, through which the transverse pin passes, and which disengages from the instep when the ankle cuff tilts backwards.

BRIEF DESCRIPTION OF THE DRAWINGS

In order that the invention may be more clearly understood reference will now be made to the accompanying drawings which show certain embodiments thereof by way of example, and in which:

FIG. 5 is a perspective view of a further embodiment,

FIG. 6 shows the latch device for the ankle cuff of the ski-boot shown in FIG. 5, FIG. 7 shows an arrangement for limiting the movement of the ski-boot in FIG. 5.

DETAILED DESCRIPTION OF PREFERRED EMBODIMENTS

Figure 3:
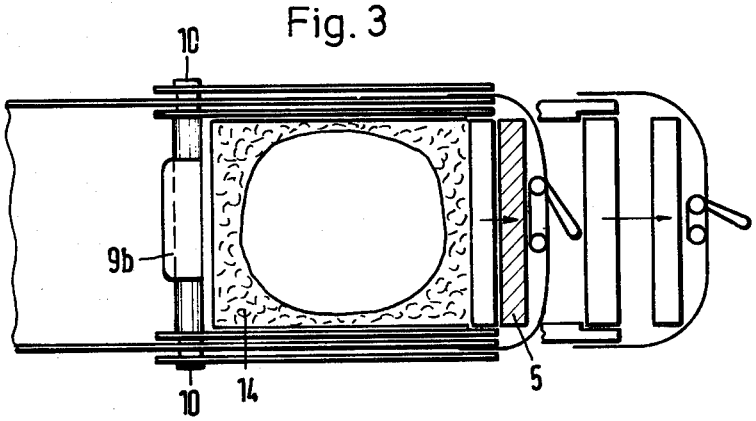
FIG. 3 is a plan view of the ski-boot shown in FIG. 1.
Figure 2:
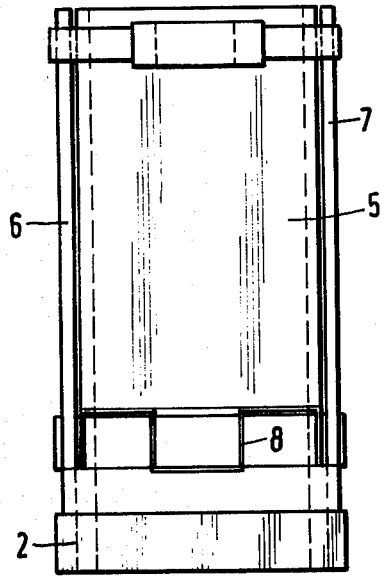
FIG. 2 is a view of the ski-boot shown in FIG. 1 from the rear.
Figure 1:
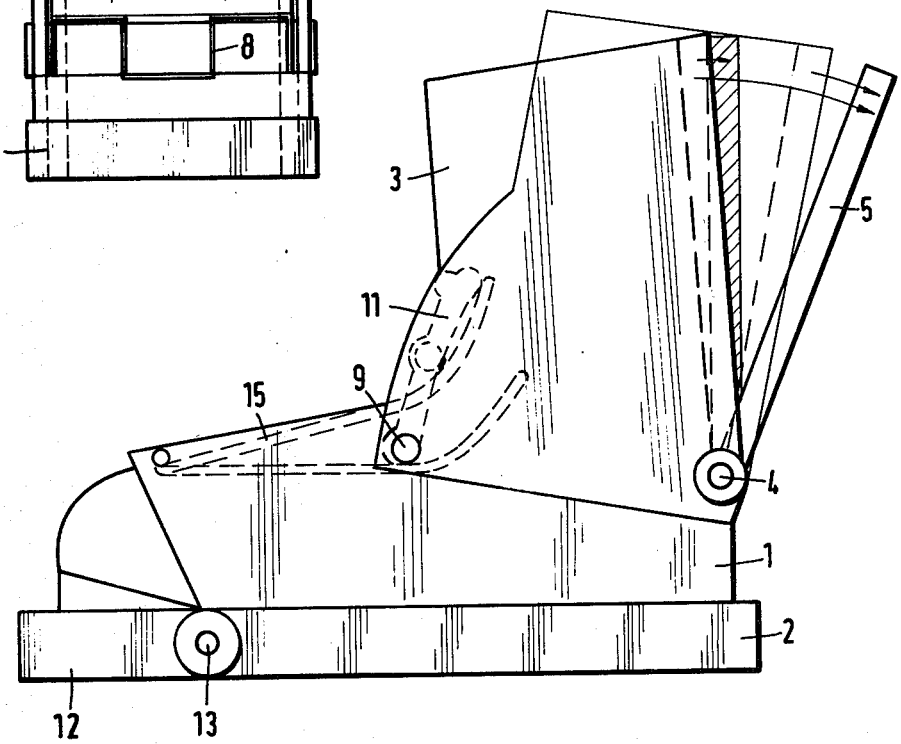
FIG. 1 is a side-view of a ski-boot according to the invention.

Referring now to the drawings, the ski-boot shown in FIGS. 1 to 3 comprises a bottom part 1 having a sole 2, and a cuff 3 for the ankle which is connected to the bottom part 1 of the boot, by a pivot shaft 4 extending transversely to the longitudinal direction of the boot, in such a way as to be able to pivot. Depending upon the size of the wearer's foot, the pivot shaft 4 is arranged at a distance of 5 to 15 cm above the sole of the boot near the rear end of the boot, with the pivot shaft fitting in the hollow formed in the foot above the heel bone (tuber calcanei) between the heel and the lower leg.

The ankle cuff 3 has a rear wall 5 which is able to fold to the rear and two plane side-walls 6 and 7 which are arranged parallel to one another. The rear wall 5 and the side-walls 6 and 7 are connected together by a hinge 8 so that the rear wall 5 is able to fold backwards. The axis of the hinge may be situated on the axis of the pivot shaft 4. At the front end of the side-walls 6 and 7 of the ankle cuff 3 is situated a transverse pin 9 whose outwardly projecting ends 10 project into in curved guides 11 in the form of elongated holes having end of travel stops in the plane side-wall sections of the bottom part 1 of the boot respectively associated with them.

The toe-section 12 of the sole 2 of the boot is rotatable about a pivot shaft 13 extending parallel to pivot shaft 4 so that the toe-section 12 of the sole can be pivoted upwards. Bending or pivoting downwards is not possible.

In the bottom part of the boot is situated in a known fashion a suitably padded inner boot 14. Also provided is a gripping device 15 which fits over the instep.

Figure 4:
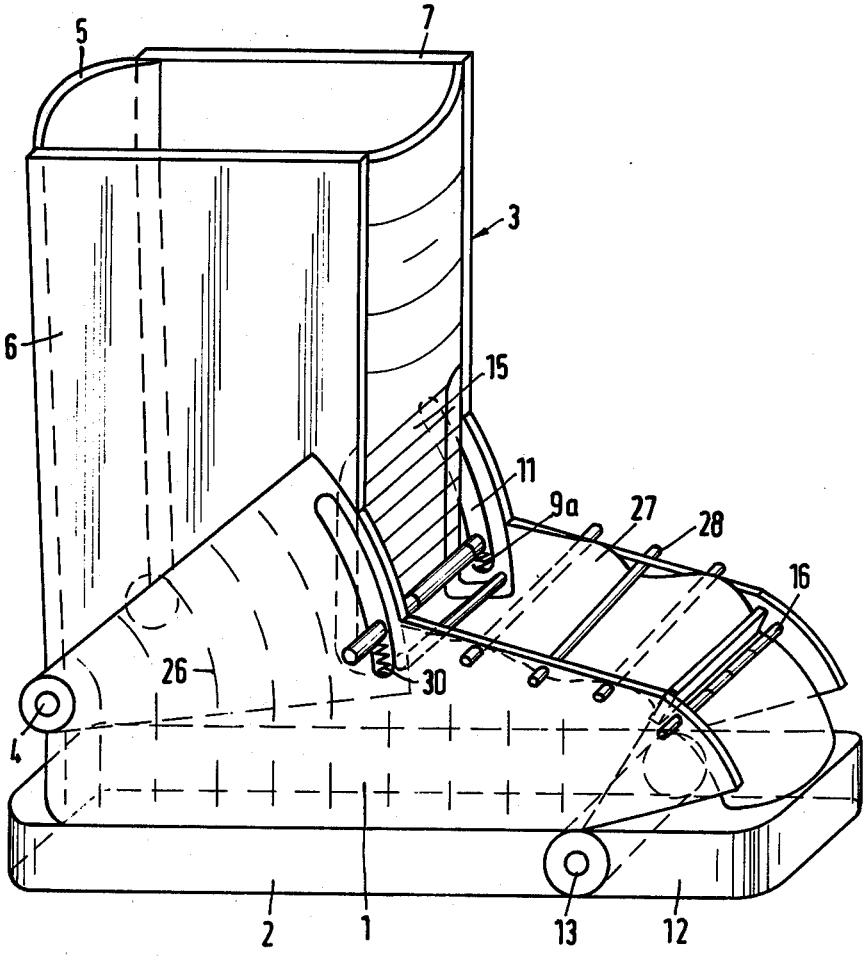
FIG. 4 is a perspective view of another embodiment.

In the embodiment shown in FIG. 4, the gripping device 15 is in the form of a yielding shaped part which rests against the instep, which is held in place on the cuff 3 at its upper end, and over which the transverse rod 9 fits. Fitted in the lower ends of the elongated guide holes 11 are compression springs 30 which brake forwardly directed movememts of the cuff 3 as soon as the transverse rod 9 comes into contact with them. In place of the compression springs, shock absorbers, resilient members or the like could also be provided.

To allow the toe-section 12 of the sole to be movable, a transverse pin 16 is provided at the front of the bottom part of the boot which is used for guiding and travel limiting purposes in a similar way to the transverse pin 9.

In the embodiment shown in FIGS. 5 to 7, the bottom part 1 of the boot has a latch device 17 which has a spring-clip 18 containing recesses 19. Situated in the spring clip 18 is an eye 31 into which a skistick can be inserted. The transverse pin 9 which fits across the instep engages in the recesses in the spring clip, a plurality of engaged positions being possible as desired.

For downhill travel, the ankle cuff 3 can be held secure in this way in a desired position on the bottom part 1 of the boot when it presses the gripping device 15 against the instep. As soon as the transverse pin 9 is released from the recesses, the cuff can be folded backwards, as a result of which the pressure of the transverse pin 9 or rather the gripping device 15 against the instep ceases and the foot has considerable freedom to move. In the present embodiment, the gripping device 15 is in the form of a stressed tension member **15*a* which is held at both ends. Further the spring-clip 18 releases the transverse pin 9 by oberload so that the ankle cuff 3** can be folded backwards.

In this embodiment also, the toe of the boot can be tilted upwards about a pivot shaft 13 arranged in the sole of the boot, being lockable by means of a latch device 20 having end of travel stops.

To release the ankle cuff 3, the eye 31 may be pulled forwards by hand or with a ski stick so that the spring clip 18 disengages from the transverse pin.

Figure 8:
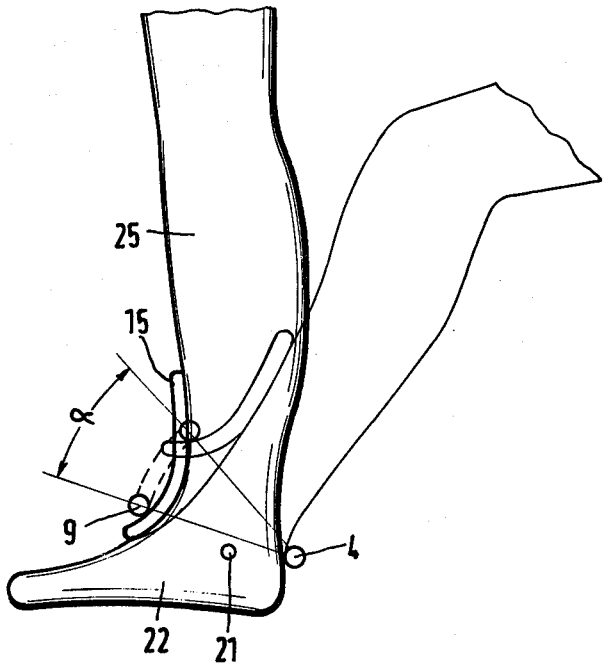
FIG. 8 shows the action of the gripping device which fits over the instep, in different positions of the leg.

FIG. 8 shows the position of the transverse pin 9 which fits across the instep and the position of the gripping device 16 alter when the cuff (not shown) is rotated through an angle $\alpha$ about its pivot shaft 4 situated to the rear of the axis of articulation 21 ot the ankle joint. Whereas the instep of the foot 22 is held secure when the transverse pin 9 is in the lower position, when the leg is in a backward tilted position there is no pressure on the instep, which eases the blood circulation and allows the foot greater freedom to move and makes it easier to slide the foot into the ski boot.

Figure 9:
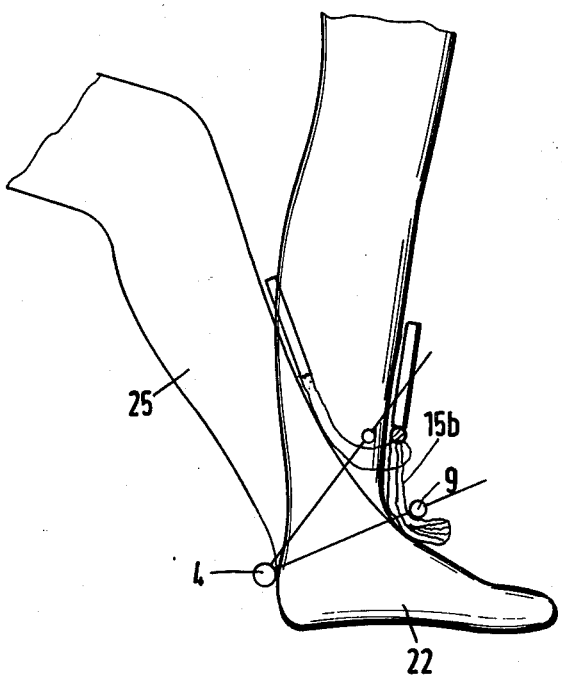
FIG. 9 shows another embodiment of the gripping device which fits over the instep.

In the embodiment shown in FIG. 9, the gripping device 15 is shown as a resilient pad **15*b* which is held at the upper and/or lower ends. However in other embodiments, the gripping device 16** may be rigid.

Figure 10:
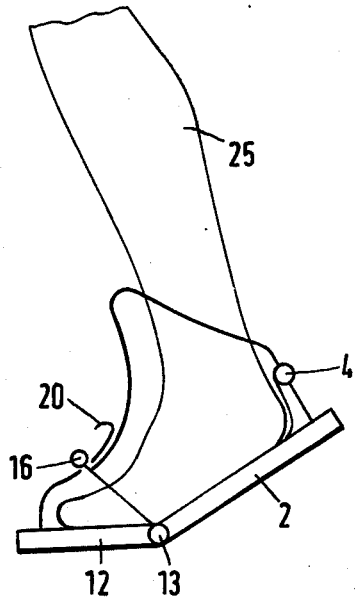
FIG. 10 shows the action of the movable toe-part in the walking position.

Walking is made easier in particular by the mobility of the toe-section 12 of the sole, as shown in FIG. 10, since the foot can roll on its ball, but on the other hand the possiblity exists of keeping the sole 2 of the boot locked in the unbent position, that is to say without a downward flexure, as is necessary when the ski is attached.

Figure 11:
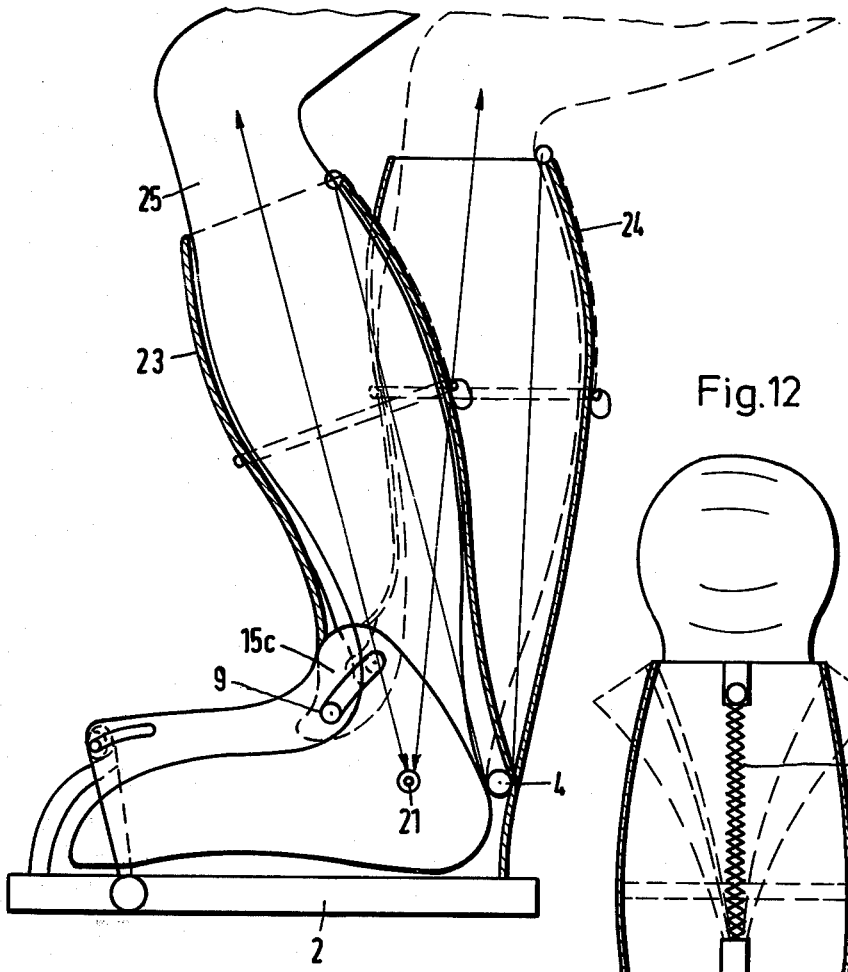
FIG. 11 is a sectional view of a ski-boot designed as a knee boot.
Figure 12:
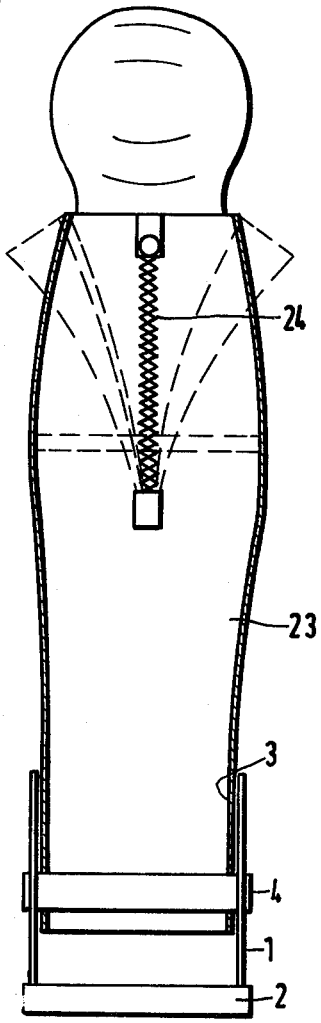
FIG. 12 is a view of the knee-boot shown in FIG. 11 from the rear.

In the embodiment shown in FIGS. 11 and 12, the ski-boot is the form of a knee boot. At the rear the leg 23 of the boot has a sliding-clasp fastener 24. Owing to the arrangement of the pivot shaft 4 near the rear end of the ski-boot on a level with the axis of articulation of the ankle joint, the lower leg 25 is withdrawn slightly from the leg 23 of the boot when the transverse pin 9 is latched in place in the downhill skiing position. As a result the calf presses against the inner wall of the leg of the boot and in this way the lower leg is held secure. In this case the gripping device 15 is in the form of a resilient pad **15*c***.

As FIG. 4 shows, it is advantageous for a freely rotatable roller **9*a* to be mounted on the transverse pin 9, which roller may have a pressure surface 9*b* of increased area (FIG. 3) to improve the effect of the pressure from the transverse pin 9 against the gripping device 15**.

To reduce the frictional resistance between the bottom part 1 of the boot and the ankle cuff 3, the mutually adjacent faces of the side walls 6, 7 of the cuff and/or of the side-wall sections of the bottom part 1 of the boot may have spacer ridges 26, which may be of a curved shape to match the arc through which the cuff for the ankle pivots (FIG. 4).

In FIG. 4, the upper face of the bottom part 1 of the boot is provided with a removable covering 27 of undulating configuration which is held in place by transverse rods 28 which are arranged at a distance from one another and which fit alternately under and over the covering.

Figure 13:
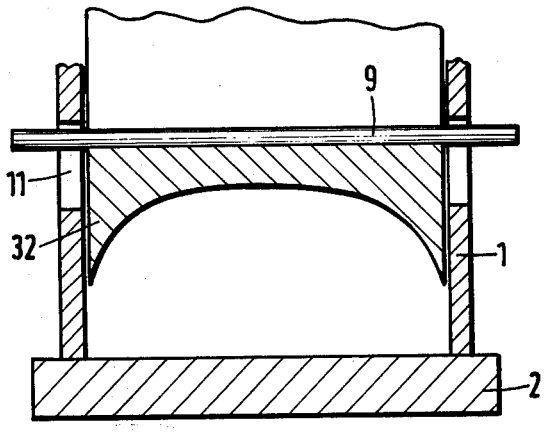
FIG. 13 is a section through another embodiment of the gripping device which fits over the instep.

In FIG. 13, the transverse pin 9 which is guided in the elongated guide holes in the bottom part 1 of the boot has connected to it a gripping device 32 which is adapted to the shape of the front part of the foot. In the position shown, the gripping device 32 engages with the front part of the foot and holds the foot securely in place.

Figure 14:
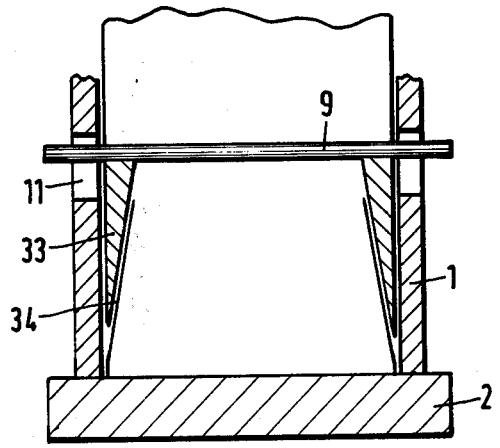
FIG. 14 shows another embodiment of the gripping device which fits over the instep.

In FIG. 14, downwardly extending wedges 33 are secured near the ends of the transverse pin 9 and co-operate with resilient foot grips 44 which are arranged on the bottom part 1 of the boot near the inside faces. In the position shown, the wedges 33 on the transverse pin 9 press the grips 34 against the foot so that it is held securely in position. The transverse pin 9 may also have a gripping device 32 as shown in FIG. 13.

Figure 15:
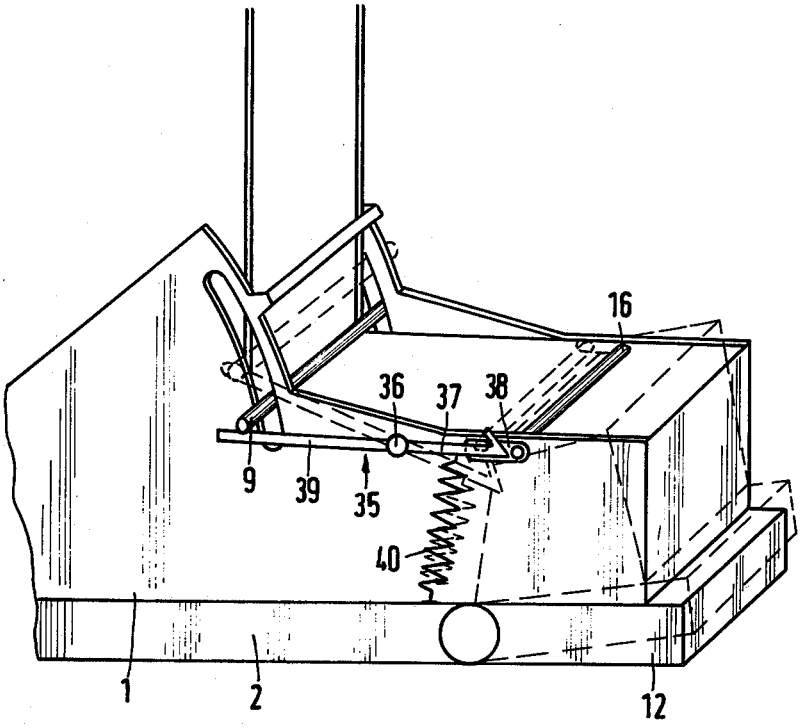
FIG. 15 shows a locking device for the upwardly pivotable toe-section of the sole.

In FIG. 15, a two-ended locking lever 35 is arranged on the bottom part 1 of the boot between the toe-section 12 and the transverse pin 9 to pivot about an axis 36 extending transversely to the longitudinal direction of the boot. The front end 37 of the lever has a stop 38 which co-operates with the transverse pin 16 belonging to the toe of the boot, whereas the rear end 39 of the lever co-operates with the transverse pin 9. A pre-tensioned traction spring 40 is arranged between the lower part 1 of the front end 37 of the lever.

With the cuff 3 in the position shown the transverse pin 9 forces end 39 of the two-ended lever 35 downwards in opposition to the traction spring 40 so that the stop 38 engages with the transverse pin 16 and thus prevents the toe-section of the sole from moving upwards. If the cuff 3 is moved backwards, the lever 35 is able to pivot to the position shown in broken lines in FIG. 15, in which it is possible for the toe-section of the sole to move upwards, under the prompting of spring 40.

I claim:

1. In a ski-boot of the kind comprising a bottom part to carry the foot and an ankle cuff which is pivotable on said bottom part of the boot about a first pivot shaft extending transversely to the longitudinal direction of the boot, both said bottom part and said ankle cuff being made from a rigid material, the invention which consists in that said ankle cuff has plane side-walls arranged parallel to and at a distance from one another which rest against the insides of plane side-walls sections of said bottom part of the boot which are respectively associated with them, in that said first pivot shaft connecting said ankle cuff and said bottom part of the boot is arranged above the sole of the boot and to the rear of an axis aligned with the ankle joint of the intended wearer, (i.e. 5 to 10 cms above said boot sole) and in that at the front end said ankle cuff has a transverse pin orientated parallel to said pivot shaft whose ends are guided in a guide track of curved configuration in said bottom part of the boot.

2. A ski boot according to claim 1, wherein said pivot shaft is arranged at the same distance from said boot sole as the axis aligned with the ankle joint of the intended wearer.

3. A ski-boot according to claim 1, wherein two end-of-travel stops are provided for said transverse pin and a latch device which holds said transverse pin in position until a predetermined restraining, force is overcome.

4. A ski-boot according to claim 3, wherein said end-of-travel stops are in the form of devices selected from the group comprising compression springs, resilient members and shock absorbers.

5. A ski-boot according to claim 1, wherein a spring clip is arranged on said bottom part of the boot and contains recesses in which said transverse pin is able to engage.

6. A ski-boot according to claim 5, wherein an actuating eye is connected to said spring clip.

7. A ski-boot according to claim 1, wherein the toe of the boot and a toe-section of said sole associated with it are mounted to pivot on said bottom part of the boot, about a second pivot shaft which latter is parallel to said first pivot shaft for said ankle cuff in said boot sole.

8. A ski-boot according to claim 7, wherein said toe-section can be locked in position in a straight line with said boot sole.

9. A ski-boot according to claim 8, wherein a two-ended locking lever is rotatable about an axis extending transversely to the longitudinal direction of the boot and co-operates with said toe-section and said transverse pin.

10. A ski-boot according to claim 1, wherein a first gripping device is arranged on the side of said ankle cuff remote from said first pivot shaft, said first gripping device fitting over the boot instep, through which said transverse pin passes, and which releases from said instep when said ankle cuff tilts backwards.

11. A ski-boot according to claim 10, wherein said first gripping device is in the form of a yielding shaped part.

12. A ski-book according to claim 10 and wherein said first gripping device has padding.

13. A ski-boot according to claim 10, wherein said first gripping device is in the form of a tension member which is held at both ends.

14. A ski-boot according to claim 10, wherein a second gripping device which is adapted to the shape of a foot is firmly connected to said transverse pin.

15. A ski-boot according to claim 10, wherein wedges are connected to said transverse pin which co-operate with foot grips arranged on said bottom part of the boot near its inside walls.

16. A ski-boot according to claim 1, wherein a freely rotatable roller is mounted on said transverse pin.

17. A ski-boot according to claim 16, wherein said roller has a pressure surface of increased area.

18. A ski-boot according to claim 1, wherein spacer ridges are arranged on the outside of said plane sidewalls of said ankle cuff and/or on the inside of said plane side-wall sections of said bottom part of the boot.

19. A ski-boot according to claim 1, wherein a plurality of transverse rods is arranged at a distance from one another, parallel to said transverse pin, at the top of said bottom part of the boot and fit alternatively under and over an undulating covering.

20. A ski-boot according to claim 19, wherein said transverse rods and said covering are arranged to be detachable from said bottom part of the boot.

21. In a ski boot for an intended wearer, including an upper to carry the foot and an ankle cuff pivotable on the upper about a first pivot shaft extending transversely of the boot, both the upper and the ankle cuff being of rigid material, the improvement comprising the upper having generally planar sidewall sections, the ankle cuff having generally planar sidewalls arranged in parallel spaced relationship and resting against said planar sidewall sections of the upper, the first pivot shaft being arranged above the sole of the boot and rearward of an axis aligned with the ankle joint of the intended wearer, the front end portion of the ankle cuff having a transverse pin parallel to the first pivot shaft and the upper having curved guide tracks receiving the opposite end portions of said transverse pin.

* * * * *